US008400241B2

(12) United States Patent
Simmons

(10) Patent No.: US 8,400,241 B2
(45) Date of Patent: Mar. 19, 2013

(54) MAGNETICALLY-TRIGGERED PROXIMITY SWITCH

(75) Inventor: Michael J. Simmons, Louisville, KY (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 0 days.

(21) Appl. No.: 13/370,222

(22) Filed: Feb. 9, 2012

(65) Prior Publication Data

US 2012/0206224 A1 Aug. 16, 2012

Related U.S. Application Data

(63) Continuation-in-part of application No. 13/159,263, filed on Jun. 13, 2011.

(60) Provisional application No. 61/354,170, filed on Jun. 11, 2010.

(51) Int. Cl.
*H01H 9/00* (2006.01)

(52) U.S. Cl. ..... 335/205; 335/206; 335/207

(58) Field of Classification Search ..... 335/205–207
See application file for complete search history.

(56) References Cited

U.S. PATENT DOCUMENTS

| | | | | |
|---|---|---|---|---|
| 4,117,431 | A | 9/1978 | Eicher | |
| 4,674,338 | A | 6/1987 | Carpenter | |
| 4,837,539 | A | 6/1989 | Baker | |
| 5,877,664 | A * | 3/1999 | Jackson, Jr. | 335/205 |
| 7,187,259 | B1 * | 3/2007 | Habboosh | 335/205 |
| 2002/0149454 | A1 | 10/2002 | Nishikawa | |
| 2008/0266035 | A1 | 10/2008 | Rohrig et al. | |

FOREIGN PATENT DOCUMENTS

| | | |
|---|---|---|
| DE | 70 07 531 | 8/1970 |
| DE | 33 40 419 A1 | 5/1985 |
| EP | 0 320 112 A2 | 6/1989 |
| FR | 2 386 121 | 10/1978 |

OTHER PUBLICATIONS

International Search Report and Written Opinion for corresponding International application No. PCT/US2011/038949, dated Sep. 2, 2011.

* cited by examiner

*Primary Examiner* — Ramon Barrera
(74) *Attorney, Agent, or Firm* — Marshall, Gerstein & Borun LLP

(57) ABSTRACT

A magnetically-triggered proximity switch includes a cylindrical switch body and a bias member non-movably secured within the switch body. The proximity switch also includes first and second normally-closed contacts and first and second normally-open contacts. The proximity switch further includes a spherical contact magnet disposed within the switch body, with the contact magnet being movable relative to the bias member from a first switch position and a second switch position. In the first switch position, an attraction to the bias member maintains the contact magnet in contact with the first and second normally-closed contacts, thereby completing a circuit between the first and second normally-closed contacts. In the second switch position, an attraction to a movable target external to the switch body moves the contact magnet into contact with the first and second normally-open contacts, thereby completing a circuit between the first and second normally-open contacts.

18 Claims, 8 Drawing Sheets

MAGNETICALLY-TRIGGERED PROXIMITY SWITCH

FIELD OF THE DISCLOSURE

This disclosure relates generally to proximity switches, and, more particularly, to miniature magnetically-triggered proximity switches.

BACKGROUND

Magnetic proximity switches, also known as limit switches, are commonly used for linear position sensing. Typically, magnetically-triggered proximity switches include a sensor that is adapted to detect the presence of a target without physically contacting the target. Typically, the sensor may include a switching circuit mechanism enclosed within a switch body, and the switching circuit mechanism typically includes multiple levers and contacts that are biased into a first position by one or more springs. When the target, which generally includes a permanent magnet contained within a housing, passes within a predetermined range of the sensor, the magnetic flux generated by the target magnet triggers the switching circuit mechanism, thereby closing a normally open circuit. The closing of the normally open circuit is detected by a processor, and a signal is sent to an operator or an automated operation system to indicate the presence of the target within the predetermined range of the sensor. The target is typically secured to a displaceable element of a system, such as a valve stem, and the sensor is typically secured to a stationary element of a system, such as a valve body. When so configured, the sensor can detect when the displaceable element has changed positions. However, due to the relatively large physical size of the sensor necessary to enclose the switching circuit mechanism, typical sensors cannot be used in applications requiring the placement of the sensor in an area having limited free space. In addition, the need to provide power to the sensor also limits the applications in which the sensor can be used.

While a relatively small magnetically-triggered proximity switch may be desirable, the ability to reduce the size of the proximity switch may be limited by several factors. Specifically, if relatively high load values are required in addition to programmable logic controller ("PLC") level loads of about 5V, correspondingly large contacts are necessary to accommodate the greater loads, and these large contacts limit the ability of the switch to be reduced in size. Additionally, as previously explained, there are numerous components that are disposed within the switch housing, and the size of the relatively complex actuation assembly limits the minimum size of the switch. Such a complex actuation assembly also adds time and cost to the manufacturing of the proximity switch.

BRIEF SUMMARY OF THE DISCLOSURE

In accordance with one exemplary aspect of the present invention, a magnetically-triggered proximity switch includes a switch body and a first magnet non-movably secured within the switch body. A common arm having a first end and a second end is also included, and the second end is disposed within the switch body. The proximity switch also includes a primary arm having a first end and a second end. The second end is disposed within the switch body, and the second end includes a primary contact. In addition, the proximity switch includes a secondary arm having a first end and a second end. The second end is disposed within the switch body, and the second end also includes a secondary contact. The proximity switch also includes a cross arm disposed within the switch body. The cross arm has a first end and a second end, the first end being coupled to the common arm and the second end including a common contact. The proximity switch further includes a second magnet disposed within the switch body, and the second magnet is movable relative to the first magnet. The second magnet is coupled to the cross arm such that movement of the second magnet causes a corresponding movement of the cross arm between a first switch position and a second switch position. In the first switch position, the common contact of the cross arm is in contact with the primary contact of the primary arm, thereby completing a circuit between the common arm and the primary arm. In the second switch position, the common contact of the cross arm is in contact with the secondary contact of the secondary arm, thereby completing a circuit between the common arm and the secondary arm.

In another embodiment, the first magnet and the second magnet are selected to create a first magnetic force between the first magnet and the second magnet, and the first magnetic force maintains the cross arm in the first switch position. In addition, the second magnet and a target outside of the switch body are selected to create a second magnetic force between the second magnet and the target, and the second magnetic force causes the cross arm to move from the first switch position to the second switch position if the second magnetic force is greater than the first magnetic force.

In a further embodiment, when the second magnetic force between the target and the second magnet becomes weaker than the first magnetic force between the first magnet and the second magnet, the first magnetic force causes the cross arm to move from the second switch position to the first switch position.

In a still further embodiment, the first end of the cross arm is pivotably coupled to the second end of the common arm, and the movement of the second magnet relative to the first magnet causes the cross arm to rotate from the first switch position to the second switch position or from the second switch position to the first switch position. In addition, an elongated actuator arm may couple the second magnet to the common arm. The actuator arm may further be disposed within an aperture formed in the first magnet.

In another embodiment, the first end of each of the common arm, the primary arm, and the secondary arm is disposed outside of the switch body. In addition, the switch body may be cylindrical, and may be comprised of a high-temperature material. Moreover, the switch body may be comprised of plastic, and the switch body may be hermetically sealed.

In accordance with another exemplary aspect of the present invention, a method of detecting a target by a magnetically-triggered proximity switch includes providing a switch body and disposing a second end of a common arm within the switch body. In addition, a primary contact of a primary arm is disposed within the switch body, and a secondary contact of a secondary arm is disposed within the switch body. The method also includes movably coupling a cross arm having a common contact to the common arm and coupling a second magnet to the common arm. A stationary first magnet is positioned within the switch body adjacent to the second magnet, and the common contact of the cross arm is biased into contact with the primary contact by the force of the first magnet acting on the second magnet. The method further includes positioning a target at a first location outside of the switch body such that the magnetic force between the target and the second magnet is greater than the magnetic force between the first magnet and the second magnet, thereby moving the cross arm such that the common contact disengages from the primary contact and engages with the secondary contact.

In another embodiment, the method also includes positioning the target at a second location outside of the switch body such that the magnetic force between the target and the second magnet is less than the magnetic force between the first magnet and the second magnet, thereby moving the cross arm such that the common contact disengages from the secondary contact and engages with the primary contact.

In a further embodiment, the cross arm is pivotally coupled to the second end of the common arm such that the cross arm pivots to disengage the common contact from the primary contact and to engage the common contact with the secondary contact.

In a still further embodiment, when the common contact engages the primary contact, a closed circuit is formed between the common arm and the primary arm, and when the common contact engages the secondary contact, a closed circuit is formed between the common arm and the secondary arm.

In an additional embodiment, the method includes disposing a first end of each of the common arm, the primary arm, and the secondary arm outside of the switch body. In addition, the method may include hermetically sealing the switch body.

In accordance with a further exemplary aspect of the present invention, a magnetically-triggered proximity switch includes a switch body extending along a body longitudinal axis and a bias member non-movably secured within the switch body. The magnetically-triggered proximity switch also includes a first normally-closed contact having an engagement arm, a second normally-closed contact having an engagement arm, a first normally-open contact having an engagement arm, and a second normally-open contact having an engagement arm. The magnetically-triggered proximity switch further includes a contact magnet disposed within the switch body, the contact magnet being movable relative to the bias member such that the contact magnet is movable between a first switch position and a second switch position. In the first switch position, the contact magnet contacts a portion of the engagement arm of the first normally-closed contact and a portion of the engagement arm of the second normally-closed contact, thereby completing a circuit between the first normally-closed contact and the second normally-closed contact. In the second switch position, the contact magnet contacts a portion of the engagement arm of the first normally-open contact and a portion of the engagement arm of the second normally-open contact, thereby completing a circuit between the first normally-open contact and the second normally-open contact.

In accordance with another exemplary aspect of the present invention, a method of detecting a target by a magnetically-triggered proximity switch includes providing a switch body and disposing a pair of normally-closed contacts within the switch body and disposing a pair of normally-open contacts within the switch body. The method also includes positioning a stationary bias member within the switch body, movably disposing a contact magnet adjacent to the bias member, and biasing the contact magnet into engagement with the pair of normally-closed contacts by the force of the bias member acting on the contact magnet. The method further includes positioning a target at a first location outside of the switch body such that the magnetic force between the target and the contact magnet is greater than the magnetic force between the bias member and the contact magnet, thereby moving the contact magnet out of engagement with the pair of normally-closed contacts and into engagement with the pair of normally-open contacts.

DETAILED DESCRIPTION

Figure 1A:
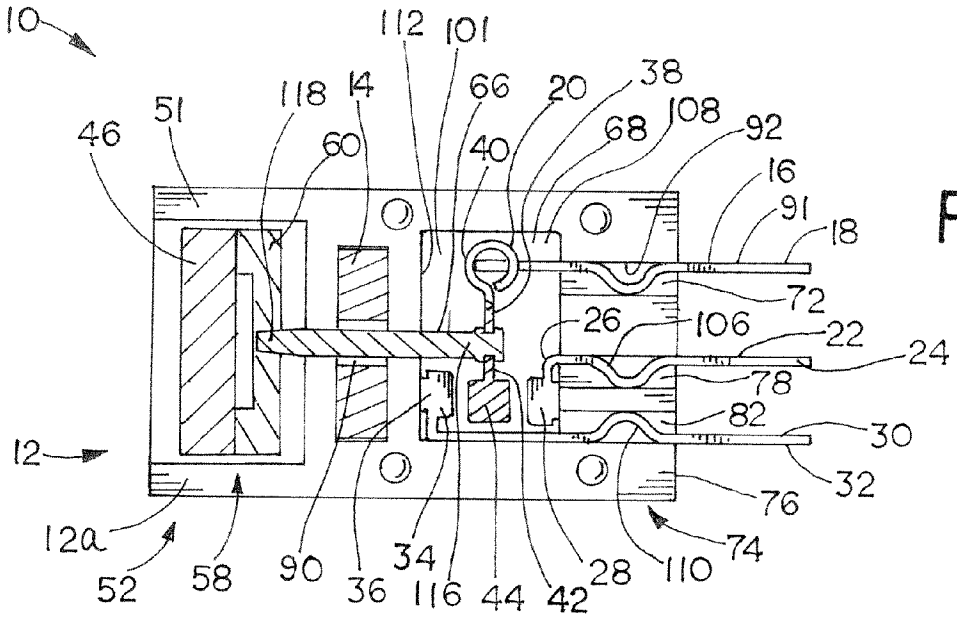
FIG. 1A is a top semi-sectional view of an embodiment of a magnetically-triggered proximity switch.
Figure 6A:
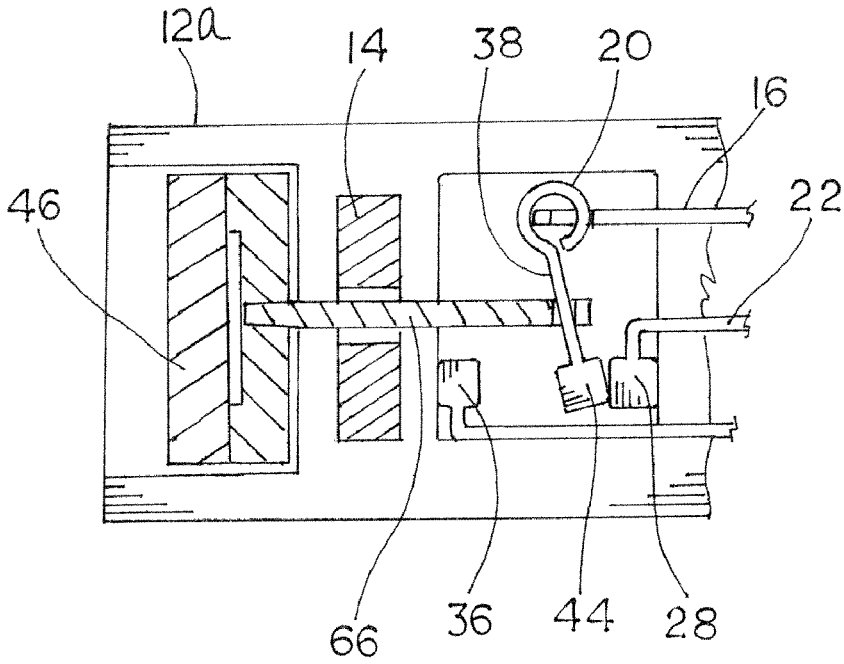
FIG. 6A is semi-sectional view of an embodiment of a magnetically-triggered proximity switch in a first switch position.
Figure 6B:
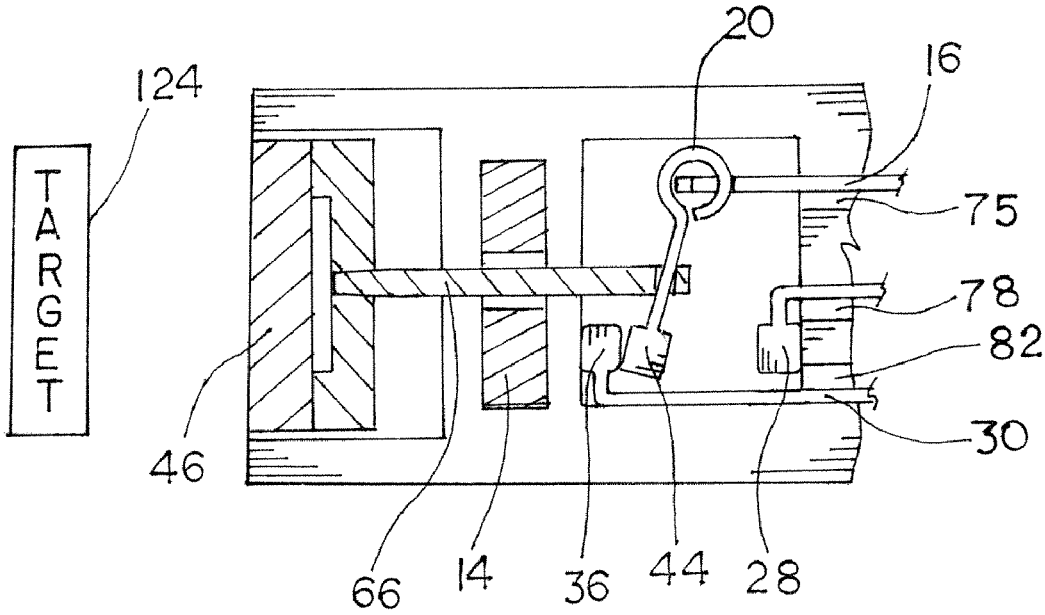
FIG. 6B is semi-sectional view of an embodiment of a magnetically-triggered proximity switch in a second switch position.

As illustrated in FIG. 1A, a magnetically-triggered proximity switch 10 includes a switch body 12 and a first magnet 14 non-movably secured within the switch body 12. The proximity switch 10 also includes a common arm 16 having a first end 18 and a second end 20, and the second end 20 of the common arm 16 is disposed within the switch body 12. The proximity switch 10 further includes a primary arm 22 having a first end 24 and a second end 26. The second end 26 is disposed within the switch body 12, and the second end 26 includes a primary contact 28. In addition, the proximity switch includes a secondary arm 30 having a first end 32 and a second end 34. The second end 34 is disposed within the switch body 12, and the second end 34 includes a secondary contact 36. A cross arm 38 is disposed within the switch body 12, and the cross arm 38 has a first end 40 and a second end 42. The first end 40 is coupled to the common arm 16 and the second end 42 includes a common contact 44. A second magnet 46 is disposed within the switch body 12, and the second magnet 46 is movable relative to the first magnet 14. Specifically, the second magnet 46 is coupled to the cross arm 38 such that movement of the second magnet 46 causes a corresponding movement of the cross arm 38 between a first switch position and a second switch position. In the first switch position, illustrated in FIG. 6A, the common contact 44 of the cross arm 38 is in contact with the primary contact 28 of the primary arm 22, thereby completing a circuit between the common arm 16 and the primary arm 22. In the second switch position, shown in FIG. 6B, the common contact 44 of the cross arm 38 is in contact with the secondary contact 36 of the secondary arm 30, thereby completing a circuit between the common arm 16 and the secondary arm 30.

Figure 1C:
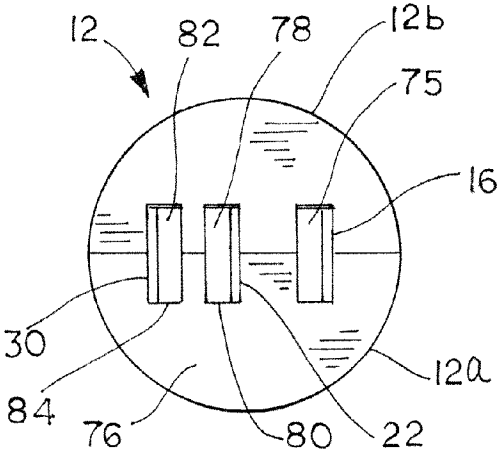
FIG. 1C is a rear view of the embodiment of FIG. 1A.
Figure 1B:
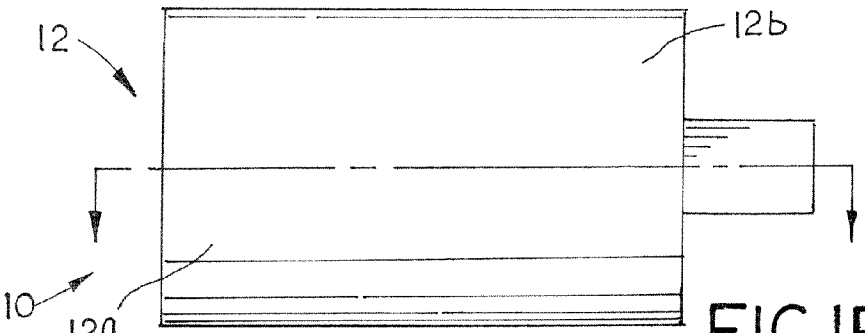
FIG. 1B is a side view of the embodiment of FIG. 1A.
Figure 3:
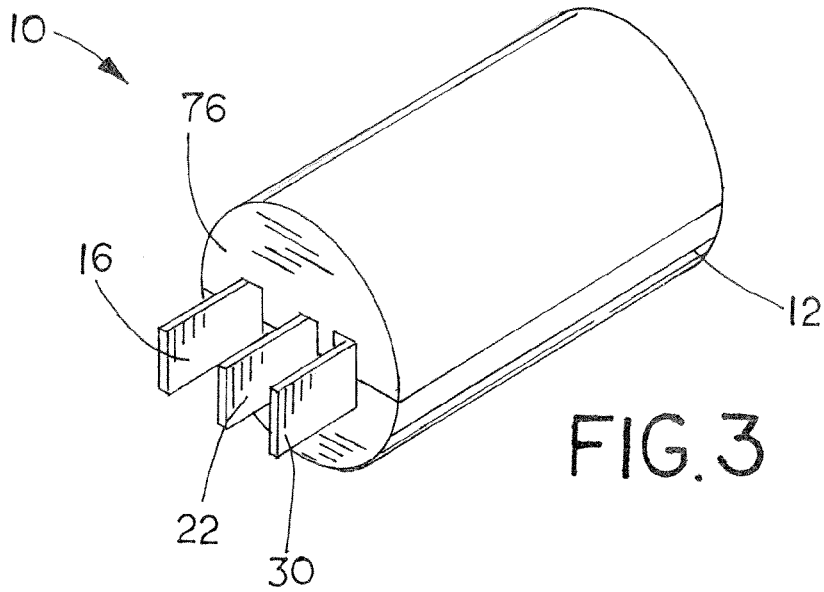
FIG. 3 is perspective view of an embodiment of a magnetically-triggered proximity switch.

FIG. 1A shows a cross-sectional view of the switch body 12 of the magnetically-triggered proximity switch 10. The switch body 12 preferably has a generally cylindrical shape having a circular cross-section. However, the switch body 12 may have any cross-sectional shape, such as a polygon or an oval, for example. The switch body 12 may include a first body half 12*a* and a second body half 12*b*. Because the second body half 12*b* may be identical to the first body half 12*a*, only the first body half 12*a* is illustrated. Each of the first body half 12*a* and the second body half 12*b* may be formed from plastic and may be manufactured using conventional processes, such as injection-molding, for example. The plastic may be a high-temperature material that allows the switch body 12 to be exposed to environments that may damage conventional plastic materials. The first body half 12*a* and the second body half 12*b* may be joined into a single switch body 12, as illustrated in FIGS. 1B, 1C and 3, using any of several methods known in the art, such as ultrasonic welding or by using an adhesive. Additionally, the switch body 12 may be hermetically sealed to protect the proximity switch from water or dirt particles. However, the switch body 12 may be made of any suitable material and may be manufactured by any means known in the art.

Figure 4:
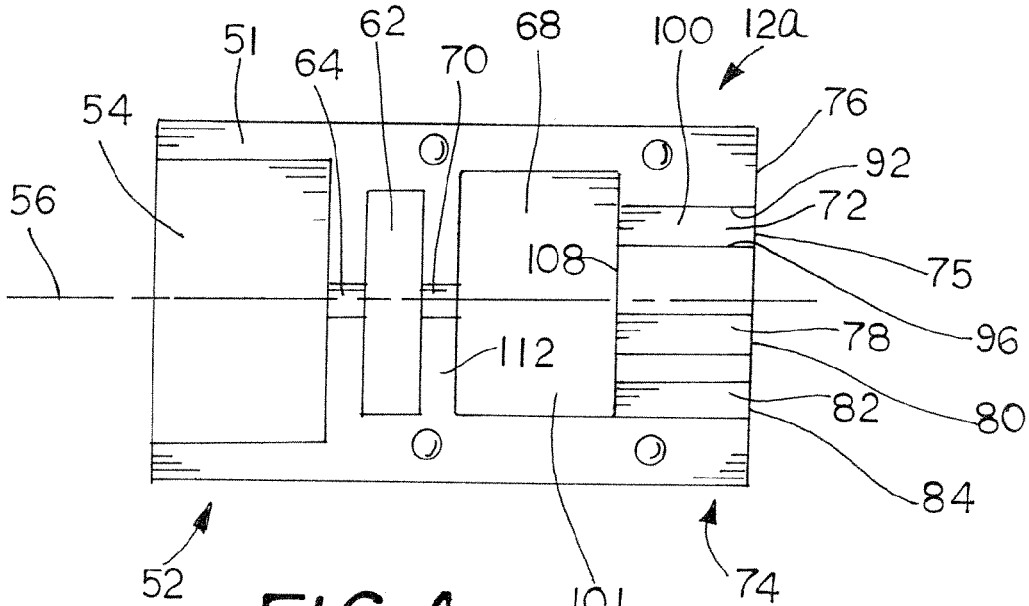
FIG. 4 is top view of a first body half of an embodiment of a magnetically-triggered proximity switch.

As illustrated in FIGS. 1A and 4, the semi-cylindrical first body half 12*a* of the switch body 12 may have a substantially planar mating surface 51 that is adapted to engage a corresponding mating surface (not shown) of the second body half 12*b* to form the switch body 12. The first body half 12*a* also includes an open first end 52 that includes a semi-cylindrical second magnet cavity 54, and the second magnet cavity 54 may inwardly extend along a longitudinal axis 56 of the body 12 that extends along the plane of the mating surface 51. The second magnet cavity 54 may be sized to receive a detector magnet assembly 58, illustrated in FIG. 2, that includes the disk-shaped second magnet 46 and a magnet base 60 coupled to the second magnet 46, and the detector magnet assembly 58 may slidably displace within the second magnet cavity 54 along the longitudinal axis 56.

A semi-cylindrical first magnet cavity 62 may also be formed in the first body half 12*a* to receive and secure the first magnet 14 within the body such that a longitudinal axis of the disk-shaped first magnet 14 is substantially aligned with the longitudinal axis 56 of the first body half 12*a*. A semi-cylindrical upper arm cavity 64 may extend along the longitudinal axis 56 between the second magnet cavity 54 and the first magnet cavity 62, and the upper arm cavity 64 may be sized to receive an elongated actuator arm 66 that extends between the cross-arm 38 and the magnet base 60. A generally rectangular contact cavity 68 may be formed in the first body half 12*a* to receive the second end 20 of the common arm 16, the second end 26 of the primary arm 22, the second end 34 of the secondary arm 30, the cross arm 38, and a first end 116 of the actuator arm 66. A semi-cylindrical lower arm cavity 70 may extend along the longitudinal axis 56 between the first magnet cavity 62 and the contact cavity 68, and the lower arm cavity 70 may be sized to receive the actuator arm 66. A rectangular common slot 72 may extend from the contact cavity 68 to a second end 74 of the first body half 12*a* in a direction generally parallel to the longitudinal axis 56 such that the common slot 72 forms a common aperture 75 in a rear face 76 of the first body half 12*a*. The common slot 72 may be sized to receive the common arm 16 such that the first end 18 of the common arm 16 extends through the common aperture 75 formed in the rear face 76. A rectangular primary slot 78 may extend from the contact cavity 68 to the second end 74 of the first body half 12*a* in a direction generally parallel to and offset from the common slot 72 such that the primary slot 78 forms a primary aperture 80 in the rear face 76 of the first body half 12*a*. The primary slot 78 may be sized to receive the primary arm 22 such that the first end 24 of the primary arm 22 extends through the primary aperture 80 in the rear face 76. In addition, a rectangular secondary slot 82 may extend from the contact cavity 68 to the second end 74 of the first body half 12*a* in a direction generally parallel to and offset from both the common slot 72 and the primary slot 78 such that the secondary slot 82 forms a secondary aperture 84 in the rear face 76 of the first body half 12*a*. The secondary slot 82 may be sized to receive the secondary arm 32 such that the first end 32 of the secondary arm 32 extends through the secondary aperture 84 in the rear face 76.

As discussed above and as illustrated in FIGS. 1A and 2, the magnetically-triggered proximity switch 10 also includes a detector magnet assembly 58 slidably disposed within the second magnet cavity 54 of the first body half 12*a* and the second body half 12*b* of the switch body 12. The detector magnet assembly 58 may include a second magnet 46, also called a detector magnet, that may be cylindrical in shape. Preferably, the second magnet 46 has the shape of a disk. The second magnet 46 may be a permanent magnet or any other type of suitable magnet. The detector magnet assembly 58 may also include a magnet base 60 that may have a planar bottom portion 86 and a circumferential side wall 88 that extends away from the bottom portion 86. The bottom portion 86 and side wall 88 may be dimensioned to receive the second magnet 46 such that a planar surface of the second magnet 46 is proximate to the top of the side wall 88 and the outside radius of the second magnet 46 is slightly less than the inner radius of the side wall 88. The magnet base 60 may be made from a metal, such as stainless steel, and the second magnet 46 may be secured to the magnet base 60 by a magnetic force. Alternatively, the magnet base 60 may be made from a non-magnetic material, and the second magnet 46 may be mechanically or adhesively secured to the magnet base 60.

Referring again to FIGS. 1A and 2, the magnetically-triggered proximity switch 10 further includes a first magnet 14, also called a bias magnet. The first magnet 14 may be cylindrical in shape, and may have the shape of a disk. The first magnet 14 may also have an aperture 90 formed along the central longitudinal axis of the first magnet 14, and the aperture 90 may be sized to receive the actuator arm 66. The first magnet 14 may be received into the first magnet cavity 62 of the switch body 12 such that the first magnet 14 cannot displace when the first body half 12*a* and the second body half 12*b* are joined together to form the switch body 12. The first magnet 14 may be made from the same material as the second magnet 46, but the radius and the thickness of the first magnet 14 may each be smaller than the respective radius and thickness of the second magnet 46. The first magnet 14 may be positioned within the first magnet cavity 62 such that the second magnet 46 is attracted towards the first magnet 14. That is, if a north pole of the second magnet 46 faces the second end 74 of the switch body 12, a south pole of the first magnet 14 is disposed facing the north pole of the second magnet 46. Conversely, if a south pole of the second magnet 46 faces the second end 74 of the switch body 12, a north pole of the first magnet 14 is disposed facing the south pole of the second magnet 46.

Figure 2:
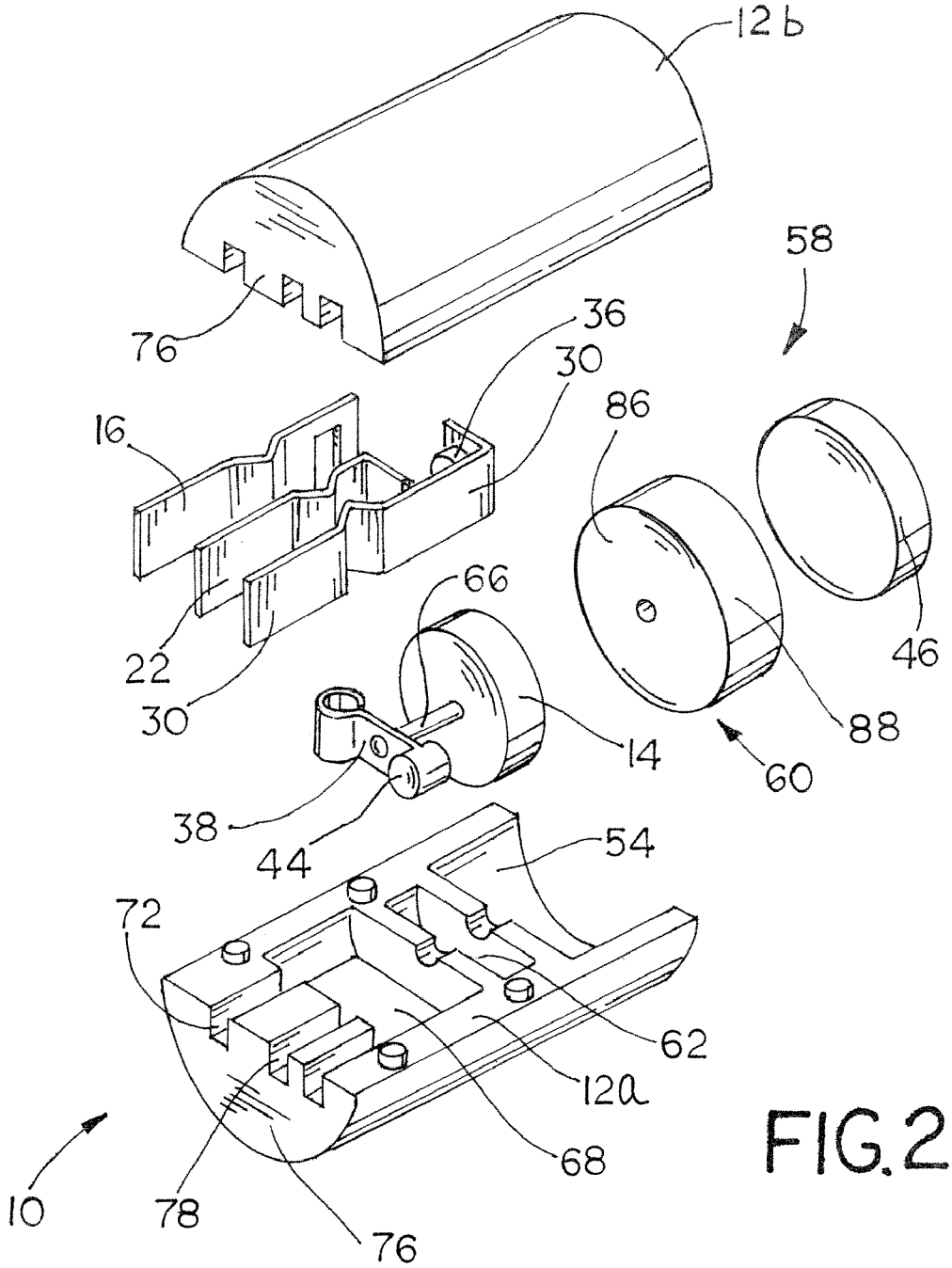
FIG. 2 is an exploded perspective view of an embodiment of a magnetically-triggered proximity switch.
Figure 5A:
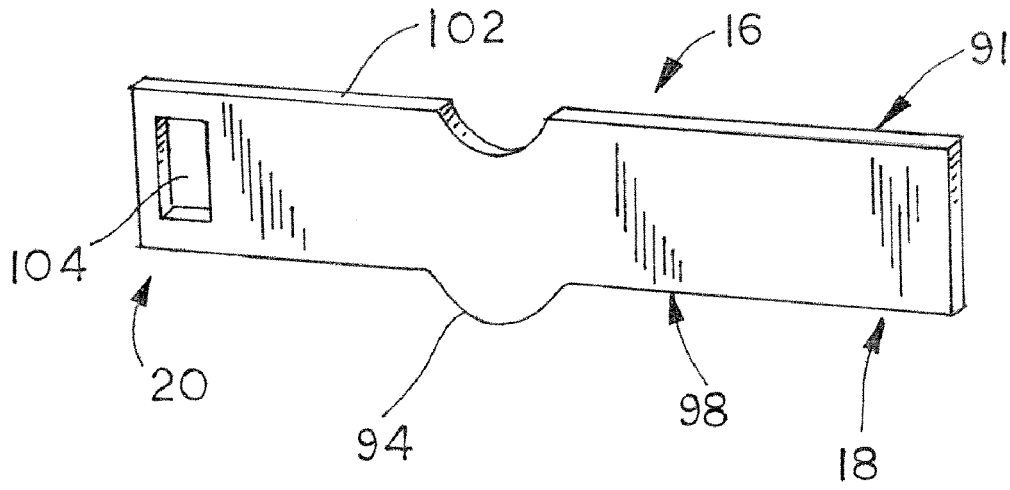
FIG. 5A is perspective view of a common arm of an embodiment of a magnetically-triggered proximity switch.

Referring to FIGS. 1A, 2, and 5A, the magnetically-triggered proximity switch 10 also includes a common arm 16, which is a common component of the circuit formed by the first switch position and the circuit formed by the second switch position. The common arm 16 may be a narrow strip of a conducting metal, such as copper or a copper alloy, and the common arm 16 may be formed from a stamping process. As discussed above, the second end 20 of the common arm 16 is disposed within the contact cavity 68 such that common arm 16 extends through the common slot 72 formed in the switch body 12, and the first end 18 protrudes through the common aperture 75 to a position outside of the switch body 12. The common arm 16 may be positioned within the common slot 72 such a longitudinal axis of the common arm 16 is parallel to the longitudinal axis 56 of the switch body 12, while in a transverse direction, the common arm 16 is perpendicular to the plane passing through the mating surface 51 of the first body half 12*a*. A rear surface 91 of the common arm 16 may contact a first wall 92 of the common slot 72, the first wall 92 being longitudinally aligned with the common arm 16 and perpendicular to the plane of the mating surface 51, as shown in FIG. 4. A portion of the common arm 16 disposed within the common slot 72 may be curved, and a top surface of the curved portion 94 may contact a second wall 96 forming the common slot 72, the second wall 96 being offset from and parallel to the first wall 92. Because the transverse distance between the top surface of the curved portion 94 and the rear surface 91 of the common arm 16 is greater than the distance between the first wall 92 and second wall 96 of the common slot 72, an interference fit is provided that secures the common arm 16 within the common slot 72. A bottom surface 98 of the common arm 16 may contact a third wall 100 forming the common slot 72 of the first body half 12*a*, the third wall 100 being perpendicular to the first wall 92 and the second wall 96, and a top surface 102 of the common arm 16 may contact a fourth wall (not shown) of the corresponding common slot 72 of the second body half 12*b* when the first body half 12*a* and the second body half 12*b* are assembled into the switch body 12. Because the third wall 100 of the common slot 72 is closer to the plane formed by the mating surface 51 than a bottom surface 98 of the contact cavity 68, a gap exists between the bottom surface 101 of the common arm 16 and the bottom surface 101 of the contact cavity 68 of the first body half 12*a*. Similarly, a gap exists between the top surface 102 of the common arm 16 and the top surface (not shown) of the contact cavity 68 of the second body half 12*b*. The common arm 16 may also include a transverse slot 104 that extends across the width of the common arm 16 proximate to the second end 20.

Referring to FIGS. 1A and 2, the magnetically-triggered proximity switch 10 also includes a primary arm 22. The primary arm 22 may be made from the same material as the common arm 16, and the primary arm 22 may engage the primary slot 78 in the same manner that the common arm 16 engages the common slot 72. Accordingly, a curved portion 106 of the primary arm 22 provides an interference fit within the primary slot 78 to retain the primary arm 22 within the primary slot 78. In addition, the first end 24 of the primary arm 22 extends from the primary aperture 80 formed in the rear face 76 of the switch body 12 such that when viewed normal to the mating surface 51, the first end 24 of the primary arm 22 is parallel to the first end 18 of the common arm 16. The second end 26 of the primary arm 22 is coupled to a primary contact 28. The primary contact 28 may be made from a conductive metal, such as copper or a copper alloy, and the primary contact 28 may be secured to the primary arm 22 in any manner known in the art, such as soldering or mechanical fastening. Alternatively, the primary contact 28 may be integrally formed with the second end 26 of the primary arm 22. The primary contact 28 may be disposed proximate to a first cavity wall 108 that partially defines the contact cavity 68.

Referring again to FIGS. 1A and 2, the magnetically-triggered proximity switch 10 also includes a secondary arm 30. The secondary arm 30 may be made from the same material as the common arm 16, and the secondary arm 30 may engage the secondary slot 82 in the same manner that the common arm 16 engages the common slot 72. However, the secondary arm 30 may be positioned within the secondary slot 82 in a "mirror image" relationship with the primary arm 22 in the primary slot 78. More specifically, a top surface of the curved portion 110 of the secondary arm 30 may face a top surface of the curved portion 106 of the primary arm 22. As configured, the first end 32 of the secondary arm 30 extends from the secondary aperture 84 formed in the rear face 76 of the switch body 12 such that when viewed normal to the mating surface 51, the first end 32 of the secondary arm 30 is parallel to both the first end 24 of the primary arm 22 and the first end 18 of the common arm 16. The second end 34 of the secondary arm 30 is coupled to a secondary contact 36. Similar to the primary contact 28, the secondary contact 36 may be made from a conductive metal, such as copper or a copper alloy, and the secondary contact 36 may be secured to the secondary arm 30 in any manner known in the art, such as soldering or mechanical fastening. Alternatively, the secondary contact 36 may be integrally formed with the second end 34 of the secondary arm 30. The secondary contact 36 may be disposed proximate to a second cavity wall 112 of the contact cavity 68 that is offset from and parallel to the first cavity wall 108.

Figure 5B:
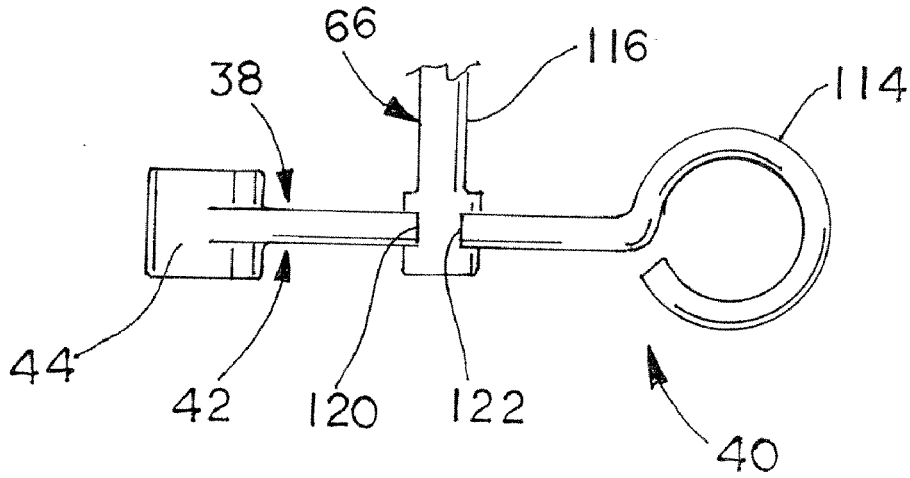
FIG. 5B is perspective view of a cross arm of an embodiment of a magnetically-triggered proximity switch.

Referring to FIGS. 1A, 2, and 5B, the magnetically-triggered proximity switch 10 also includes a cross arm 38. The cross arm 38 may be formed from a narrow strip of a conducting metal, such as copper or a copper alloy, and the common arm 16 may be formed from a stamping process and subsequent bending process. A second end 42 of the cross arm 38 may include a common contact 44. The common contact 44 may be made from a conductive metal, such as copper or a copper alloy, and the common contact 44 may be secured to the cross arm 38 in any manner known in the art, such as soldering or mechanical fastening. Alternatively, the common contact 44 may be integrally formed with the second end 42 of the cross arm 38. A first end 40 of the cross arm 38 may include an end loop 114, and a portion of the end loop 114 may be disposed within the transverse slot 104 of the common arm 16 such that the cross arm 38 may rotate about the second end 20 of the common arm 16 while maintaining contact with the common arm 16. The cross arm 38 may be rotatable about the second end 20 of the common arm 16 between a first switch position and a second switch position. In the first switch position, shown in FIG. 6A, the common contact 44 of the cross arm 38 is in contact with the primary contact 28 of the primary arm 22, thereby completing a circuit between the common arm 16 and the primary arm 22. In the second switch position, shown in FIG. 6B, the common contact 44 of the cross arm 38 is in contact with the secondary contact 36 of the secondary arm 30, thereby completing a circuit between the common arm 16 and the secondary arm 30.

Referring again to FIGS. 1A, 2, and 5B, the magnetically-triggered proximity switch 10 also includes an actuator arm 66. The actuator arm 66 may be an elongated cylinder having a first end 116 and a second end 118 opposite the first end 116.

Instead of a cylinder, the actuator arm 66 hay have any suitable cross-sectional shape or combination of shapes, such as that of a square, oval, or polygon. The actuator arm 66 may be formed from a plastic material or any other suitable material. The actuator arm 66 may be slidably disposed in the upper arm cavity 64 and the lower arm cavity 70 of the switch body 12, and each of the upper arm cavity 64 and the lower arm cavity 70 may have an inner diameter that is slightly greater than the outer diameter of the actuator arm 66. The actuator arm 66 may also extend through the aperture 90 in the first magnet 14 when the first magnet 14 is disposed within the first magnet cavity 62. The first end 116 of the actuator arm 66 may include a groove 120, and the groove 120 may receive an edge portion 122 that defines the aperture in the cross arm 38 to secure the actuator arm 66 to the cross arm 38, as shown in FIG. 5B. However, the first end 116 may be coupled to the cross arm 38 by any means known in the art, such as, for example, mechanical fastening. The second end 118 of the actuator arm 66 may be coupled to the magnet base 60 of the detector magnet assembly 58 in a manner similar to the coupling of the first end 116 to the cross arm 38.

In operation, the first magnet 14 provides a magnetic force that attracts the second magnet 46. This attractive force displaces the detector magnet assembly 58 towards the first magnet 14, thereby displacing the actuator arm 66 towards the second end 74 of the switch body 12. The displacement of the actuator arm 66 rotates the cross arm 38 about the second end 20 of the common arm 16 such that the common contact 44 is in contact with the primary contact 28. In this first switch position, shown in FIG. 6A, a circuit is completed between the primary arm 22 and the common arm 16. Accordingly, the closed circuit that results from the first switch position can be detected by a processor that is operatively connected to the first end 18 of the common arm 16 and the first end 24 of the primary arm 22.

However, when a magnetic target 124, which may include a permanent magnet or a ferrous metal, is moved into a position within a predetermined range of the proximity switch 10, the magnetic force between the target 124 and the second magnet 46 may be greater than the magnetic force between the second magnet 46 and the first magnet 14. The greater force displaces the detector magnet assembly 58 towards the target 124 and away from the first magnet 14, thereby displacing the actuator arm 66 that is rigidly coupled to the magnet base 60 of the detector magnet assembly 58. As the actuator arm 66 is displaced, the cross arm 38 is rotated about the second end 20 of the common arm 16 to move the common contact 44 out of contact with the primary contact 28 and into contact with the secondary contact 36. In this second switch position, shown in FIG. 6B, a circuit is completed between the secondary arm 30 and the common arm 16. Accordingly, the closed circuit that results from the second switch position can be detected by a processor that is operatively connected to the first end 18 of the common arm 16 and the first end 32 of the secondary arm 30. When the target is no longer within the predetermined range of the proximity switch 10, the magnetic force between the first magnet 14 and the second magnet 46 becomes greater than the magnetic force between the second magnet 46 and the target 124, and the proximity switch 10 moves into the first position in the manner described above.

One having ordinary skill in the art would recognize that the magnetic force between the target 124 and the second magnet 46 can depend on several factors, such as the relative size of the target 124 and the second magnet 46 and the distance between the target 124 and the second magnet 46, and these variables can be adjusted to provide for optimal interaction between the proximity switch 10 and the target 124. In a similar manner the magnetic force between the second magnet 46 and the first magnet 14 can also be adjusted.

One having ordinary skill in the art would also recognize that the disclosed embodiments of the magnetically-triggered proximity switch 10 allow for a relatively small switch body 12 having an integrated design, which further allows the magnetically-triggered proximity switch 10 to be used in applications with limited space requirements, such as in electrical junction boxes. It is also apparent to one having ordinary skill in the art that the disclosed embodiments of the magnetically-triggered proximity switch 10, unlike typical proximity switches, do not need an external power source to function, thereby simplifying installation and extending the working life of the proximity switch 10.

Variations can be made to the disclosed embodiments of the proximity switch 10 that are still within the scope of the appended claims. For example, instead of the single pole/single throw configuration described, a double pole/double throw configuration is also contemplated. In addition, LEDS may be included in the housing to visually indicate whether the proximity switch is in the first switch position or the second switch position.

Figure 7A:
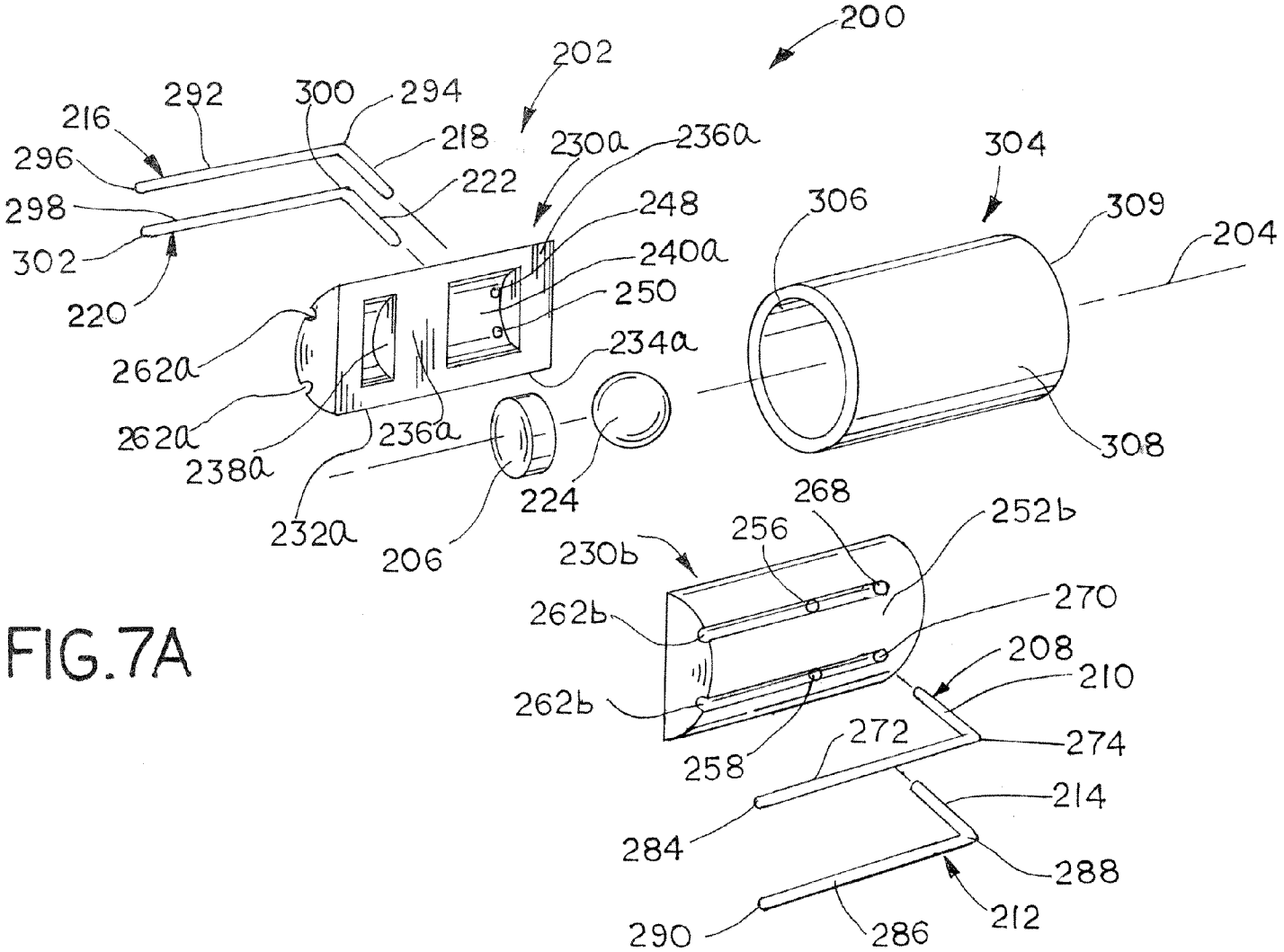
FIG. 7A is an exploded perspective view of an embodiment of a magnetically-triggered proximity switch.

FIG. 7A illustrates an alternative embodiment of a magnetically-triggered proximity switch 200 that includes a switch body 202 that extends along a body longitudinal axis 204, and a bias member 206 is non-movably secured within the switch body 202. The magnetically-triggered proximity switch 200 also includes a first normally-closed contact 208 having an engagement arm 210, a second normally-closed contact 212 having an engagement arm 214, a first normally-open contact 216 having an engagement arm 218, and a second normally-open contact 220 having an engagement arm 222. The magnetically-triggered proximity switch 200 further includes a contact magnet 224 disposed within the switch body 202, the contact magnet 224 being movable relative to the bias member 206 such that the contact magnet 224 is movable between a first switch position 226 (illustrated in FIG. 9A) and a second switch position 228 (illustrated in FIG. 9B). In the first switch position 226 illustrated in FIG. 9A, the contact magnet 224 contacts a portion of the engagement arm 210 of the first normally-closed contact 208 and a portion of the engagement arm 214 of the second normally-closed contact 212, thereby completing a circuit between the first normally-closed contact 208 and the second normally-closed contact 212. In the second switch position 228 illustrated in FIG. 9B, the contact magnet 224 contacts a portion of the engagement arm 218 of the first normally-open contact 216 and a portion of the engagement arm 222 of the second normally-open contact 220, thereby completing a circuit between the first normally-open contact 216 and the second normally-open contact 220.

Figure 7B:
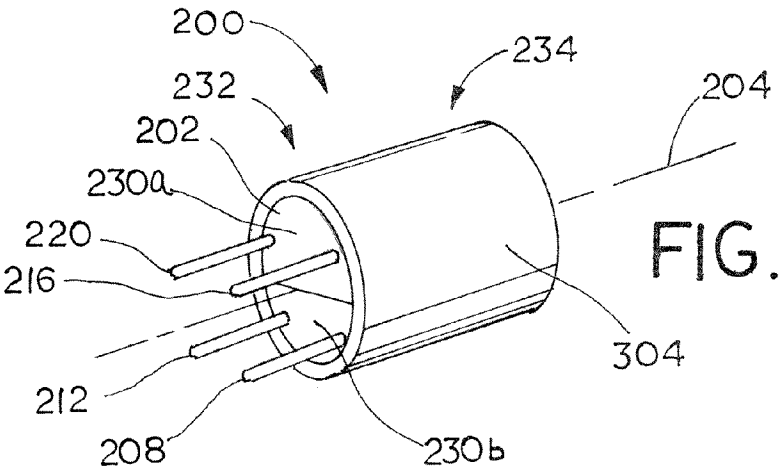
FIG. 7B is a perspective view of the embodiment of FIG. 7A.
Figure 8B:
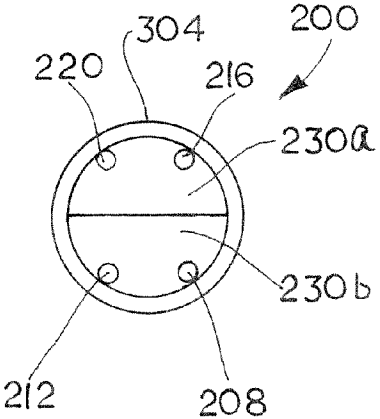
FIG. 8B is a rear view of the embodiment of FIG. 7A.
Figure 8A:
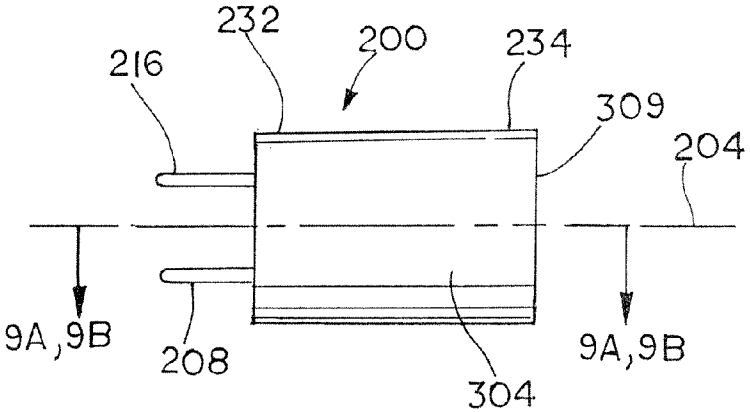
FIG. 8A is a side view of the embodiment of FIG. 7A.

Referring to FIGS. 7A and 7B, the magnetically-triggered proximity switch 200 includes the switch body 202 that extends along the body longitudinal axis 204 such that the switch body 202 has a first end 232 and a second end 234 longitudinally opposite the first end 232. The switch body 202 preferably has a generally cylindrical shape having a circular cross-section. However, the switch body 202 may have any cross-sectional shape, such as a polygon or an oval, for example. The switch body 202 may comprise a single, unitary part or may comprise two or more component parts coupled to form the switch body 202. For example, the switch body 202 may include a first body half 230*a* and a second body half 230*b* that combine to form the switch body 202, and the first body half 230*a* and the second body half 230*b* may be identical or substantially identical. Each of the first body half 230*a* and the second body half 230*b* may be formed from non-conductive material, such as plastic, ceramic, epoxy, or rubber, and may be manufactured using conventional processes, such as injection-molding, for example. The plastic may be a high-temperature material that allows the switch body 202 to be exposed to environments that may damage conventional plastic materials. The first body half 230*a* and the second body half 230*b* may be joined to form the switch body 202 using any of several methods known in the art, such as ultrasonic welding or by using an adhesive. However, the switch body 202 may be made of any suitable material and may be manufactured by any means known in the art.

As illustrated in FIGS. 7A, 9A, 9B, and 10, the first body half 230*a* of the switch body 202 may extend along the body longitudinal axis 204 from the first end 232 of the switch body 202 to the second end 234 of the switch body. The first body half 230*a* may have a substantially planar mating surface 236*a* that is adapted to engage a corresponding mating surface (not shown) of the second body half 230*b* to form the switch body 202. The first body half 230*a* may also include a first cavity 238*a*, and the first cavity 238*a* may extend along the body longitudinal axis 204 that extends along the plane of the mating surface 236*a*. The first cavity 238*a* may be disposed adjacent to the first end 232 of the switch body 202, and the first cavity 238*a* may be shaped and sized to receive a bias member 206 that will be described in more detail below. For example, the first cavity 238*a* may be semi-cylindrical and may have a longitudinal axis that is coaxial with the body longitudinal axis 204. More specifically, the first cavity 238*a* may include a planar first wall 278*a* disposed at a first longitudinal portion of the first cavity 238*a* and a planar second wall 280*a* disposed at a second longitudinal portion of the first cavity 238*a* adjacent to the first end 232 of the switch body 202. The first wall 278*a* and the second wall 280*a* may each be normal to the body longitudinal axis 204. A semi-cylindrical circumferential cavity surface 282*a* may extend between the first wall 278*a* and the second wall 280*a*, and a longitudinal axis of the circumferential cavity surface 282*a* may be coaxially-aligned with the body longitudinal axis 204. So configured, when the first body half 230*a* and the second body half 230*b* are coupled to form the switch body 202, the first cavity 238*a* of the first body half 230*a* and the first cavity 238*b* of second body half 230*b* combine to form a cylindrical first cavity 238 that is symmetrical about the body longitudinal axis 204 and that has a longitudinal axis aligned with the body longitudinal axis 204.

Still referring to FIGS. 7A, 9A, 9B, and 10, the cylindrical first cavity 238 formed by the first cavity 238*a* of the first body half 230*a* and the first cavity 238*b* of second body half 230*b* is adapted to receive a disk-shaped bias member 206 (also called a "bias disk") such that the bias member 206 is non-movably secured (or substantially non-movably secured) within the cylindrical first cavity 238 of the switch body 202. More specifically, each of the longitudinal length (i.e., the longitudinal distance between the first wall 278*a*, 278*b* and the second wall 280*a*, 280*b*) and the diameter of the cylindrical first cavity 238 (i.e., the sum of the individual radii of the semi-cylindrical circumferential cavity surface 282*a*, 282*b*) may be slightly larger (e.g., 3% to 10% larger) than each of the longitudinal length and diameter of the cylindrical bias member 206. The bias member 206 may have a longitudinal axis that is coaxially-aligned with the body longitudinal axis 204 when disposed within the first cavity 238. The bias member 206 may be made of a ferrous material (such as steel), a magnetic material, or any other material or combination of materials that results in or causes an attractive magnet force between the material and a magnet (i.e., the contact magnet 224).

Figure 9B:
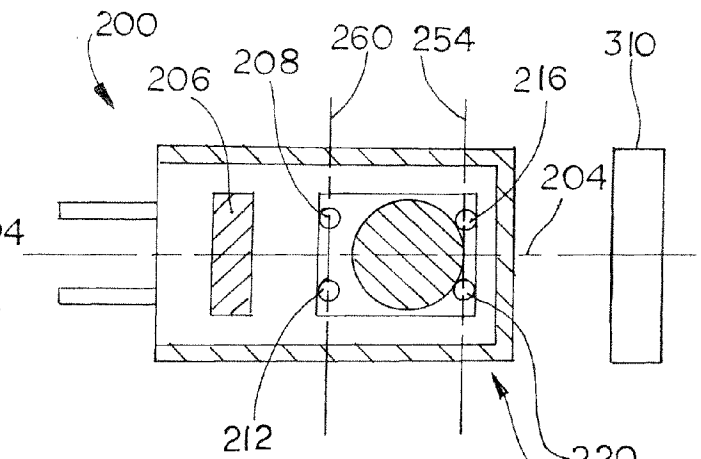
FIG. 9B is a sectional view of the embodiment of FIG. 8A taken along line 9A, 9B-9A, 9B illustrating the magnetically-triggered proximity switch in a second switch position.
Figure 9A:
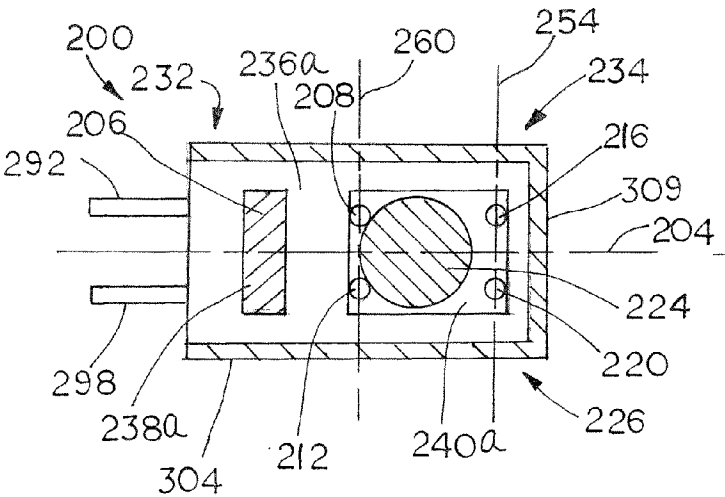
FIG. 9A is a sectional view of the embodiment of FIG. 8A taken along line 9A, 9B-9A, 9B illustrating the magnetically-triggered proximity switch in a first switch position.
Figure 10:
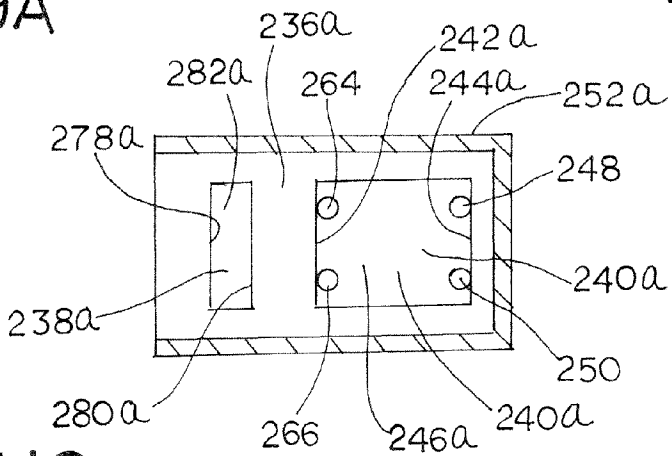
FIG. 10 is a top view of first body half of the switch body of the embodiment of FIG. 7A.

As illustrated in FIGS. 7A and 10, the first body half 230*a* of the switch body 202 may include a second cavity 240*a* formed in the switch body 202. The second cavity 240*a* may be disposed between the first cavity 238*a* and the second end 234 of the switch body 202 such that one end of the second cavity 240*a* may be adjacent to the second end 234 of the switch body 202. The second cavity 240*a* may be shaped and sized to receive a displaceable contact magnet 224 that will be described in more detail below. For example, the second cavity 240*a* may be semi-cylindrical and may have a longitudinal axis that is coaxial with the body longitudinal axis 204. More specifically, the second cavity 240*a* may include a planar first wall 242*a* disposed at a first longitudinal end of the second cavity 240*a* and a planar second wall 244*a* disposed at a second longitudinal end of the second cavity 240*a* adjacent to the second end 234 of the switch body 202. The first wall 242*a* and the second wall 244*a* may each be normal to the body longitudinal axis 204. A semi-cylindrical circumferential cavity surface 246*a* may extend between the first wall 242 and the second wall 244, and a longitudinal axis of the circumferential cavity surface 246*a* may be coaxial with the body longitudinal axis 204. So configured, when the first body half 230*a* and the second body half 230*b* are assembled to form the switch body 202, the circumferential cavity surface 246*a* of the first body half 230*a* and the circumferential cavity surface 246*b* of the second body half 230*b* cooperate to form a cylindrical surface of the second cavity 240 that is symmetrically disposed about (i.e., has a longitudinal axis co-axially aligned with) the body longitudinal axis 204. The first wall 242*a* and the second wall 244*a* may be longitudinally separated by any suitable distance to allow the contact magnet 224 to longitudinally displace from a first switch position 226 to a second switch position 228 (as illustrated FIGS. 9A and 9B) in a manner described in more detail below. The radius of the circumferential cavity surface 246*a*, 246*b* (i.e., the diameter of the second cavity 240) may have any value that allows the contact magnet 224 to longitudinally displace from a first switch position 226 to a second switch position 228 (as illustrated FIGS. 9A and 9B) in a manner described in more detail below.

Still referring to FIGS. 7A and 10, the first body half 230*a* may further include a first contact aperture 248 and a second contact aperture 250 that each extends from an exterior surface 252*a* of the first body half 230*a* to the circumferential cavity surface 246*a* of the first body half 230*a*. The first contact aperture 248 and the second contact aperture 250 may intersect the circumferential cavity surface 246*a* at or adjacent to the second wall 244*a* of the second cavity 240*a*. For example, a portion of first contact aperture 248 and a portion of the second contact aperture 250 may contact (or may be immediately adjacent to) the edge formed by the intersection of the circumferential cavity surface 246*a* and the second wall 244*a*. The first contact aperture 248 and the second contact aperture 250 may each extend along a longitudinal axis, and each longitudinal axis may be parallel and may extend along a first reference plane 254 that is orthogonal to the body longitudinal axis 204. The first contact aperture 248 and the second contact aperture 250 may be symmetrically disposed about the body longitudinal axis 204 (i.e., equidistant from the body longitudinal axis 204) when viewed normal to the planar mating surface 236*a*. The first contact aperture 248 and the second contact aperture 250 may have any suitable size and shape to receive the engagement arm 218 of the first normally-open contact 216 and the engagement arm 222 of the second normally-open contact 220, respectively. For example, if the engagement arms 218, 222 each have a circular cross-sectional shape, the first contact aperture 248 and the second contact aperture 250 may each have a circular cross-sectional shape with a diameter slightly larger than the diameter of the engagement arms 218, 222. Alternatively, the diameter of the first contact aperture 248 and the second contact aperture 250 may be substantially equal to (or slightly less than) the diameter of the engagement arms 218, 222 to allow for an interference fit to secure the engagement arms 218, 222 within the first contact aperture 248 and the second contact aperture 250. The first contact aperture 248 and the second contact aperture 250 may have one or more internal tabs, ridges, fins, or other features that may act to engage and retain the engagement arm 218 of the first normally-open contact 216 and the engagement arm 222 of the second normally-open contact 220.

Still referring to FIGS. 7A and 10, the second body half 230*b* may include a first contact aperture 256 and a second contact aperture 258 that each extends from an exterior surface 252*b* of the second body half 230*b* to the circumferential cavity surface 246*b* of the second body half 230*b*. The first contact aperture 256 and the second contact aperture 258 may intersect the circumferential cavity surface 246*b* at or adjacent to the first wall 242*b* of the second cavity 240*b* of the of the second body half 230*b*. For example, a portion of first contact aperture 256 and a portion of the second contact aperture 258 may contact (or may be immediately adjacent to) the edge formed by the intersection of the circumferential cavity surface 246*b* and the first wall 242*b*. The first contact aperture 256 and the second contact aperture 258 may each extend along a longitudinal axis, and each longitudinal axis may be parallel and may extend along a second reference plane 260 that is orthogonal to the body longitudinal axis 204 and longitudinally offset from the first reference plane 254. The first contact aperture 256 and the second contact aperture 258 may be symmetrically disposed about the body longitudinal axis 204 (i.e., equidistant from the body longitudinal axis 204) when viewed normal to the planar mating surface 236*b* of the second body half 230*b*. In addition, the longitudinal axis of the first contact aperture 248 of the first body half 230*a* may be longitudinally aligned (i.e., aligned with a reference axis that is parallel to the body longitudinal axis 204) with the longitudinal axis of the first contact aperture 256 of the second body half 230*b* when viewed normal to the planar mating surface 236*a* of the first body half 230*a*. Similarly, the longitudinal axis of the second contact aperture 250 of the first body half 230*a* may be longitudinally aligned (i.e., aligned with a reference axis that is parallel to the body longitudinal axis 204) with the longitudinal axis of the second contact aperture 258 of the second body half 230*b* when viewed normal to the planar mating surface 236*a* of the first body half 230*a*. The first contact aperture 256 and the second contact aperture 258 may have any suitable size and shape to receive the engagement arm 210 of the first normally-closed contact 208 and the engagement arm 214 of the second normally-closed contact 212, respectively. For example, if the engagement arms 210, 214 each have a circular cross-sectional shape, the first contact aperture 256 and the second contact aperture 258 may each have a circular cross-sectional shape with a diameter slightly larger than the diameter of the engagement arms 210, 214. Alternatively, the diameter of the first contact aperture 256 and the second contact aperture 258 may be substantially equal to (or slightly smaller than) the diameter of the engagement arms 210, 214 to allow for an interference fit to secure the engagement arms 210, 214 within the first contact aperture 256 and the second contact aperture 258. The first contact aperture 256 and the second contact aperture 258 may have one or more internal tabs, ridges, fins, or other features that may act to engage and retain the engagement arm 210 of the first normally-closed contact 208 and the engagement arm 214 of the second normally-closed contact 212.

As illustrated in FIGS. 7A and 10, the first body half 230*a* may also include a first auxiliary contact aperture 264 and a second auxiliary contact aperture 266 that are each coaxially aligned with the first contact aperture 256 and the second contact aperture 258, respectively, of the second body half 230*b*. Similarly, the second body half 230*b* may also include a first auxiliary contact aperture 268 and a second auxiliary contact aperture 270 that are each coaxially aligned with the first contact aperture 248 and the second contact aperture 250, respectively, of the first body half 230*a*.

Referring to FIG. 7A, the first body half 230*a* may include one or more longitudinal grooves 262*a* formed in the exterior surface 252*a*. For example, the first body half 230*a* may include two grooves 262*a* that extend along the exterior surface 252*a* such that the each of the grooves 262*a* is parallel to the body longitudinal axis 204. A first of the two grooves 262*a* may intersect the first contact aperture 248 and the first auxiliary contact aperture 264 such that each of the first contact aperture 248 and the first auxiliary contact aperture 264 intersects the exterior surface 252*a* within the first groove 262*a*. A second of the two grooves 262*a* may intersect the second contact aperture 250 and the second auxiliary contact aperture 266 such that each of the second contact aperture 250 and the second auxiliary contact aperture 266 intersects the exterior surface 252*a* within the second groove 262*a*. Each of the first and second grooves 262*a* may extend from the first end 232 of the switch body 202 to a point adjacent to the second end 234 of the switch body 202. Referring to FIGS. 7A, the second body half 230*b* may include one or more longitudinal grooves 262*b* formed in the exterior surface 252*b*. For example, the second body half 230*b* may include two grooves 262*b* that extend along the exterior surface 252*b* such that the each of the grooves 262*b* is parallel to the body longitudinal axis 204. A first of the two grooves 262*b* may intersect the first contact aperture 256 and the first auxiliary contact aperture 268 such that each of the first contact aperture 256 and the first auxiliary contact aperture 268 intersects the exterior surface 252*b* within the first groove 262*b*. A second of the two grooves 262*b* may intersect the second contact aperture 258 and the second auxiliary contact aperture 270 such that each of the second contact aperture 258 and the second auxiliary contact aperture 270 intersects the exterior surface 252*b* within the second groove 262*b*. Each of the first and second grooves 262*b* may extend from the first end 232 of the switch body 202 to a point adjacent to the second end 234 of the switch body 202. Each of the grooves 262*a*, 262*b* may have an identical cross-sectional shape that is adapted to receive a portion of one of the first normally-closed contact 208, the second normally-closed contact 212, the first normally-open contact 216, and the second normally-open contact 220 in a manner that will be described in more detail below.

As illustrated in FIGS. 7A, 7B, 8A, 8B, 9A, and 9B, the magnetically-triggered proximity switch 200 may include the first normally-closed contact 208 and the second normally-closed contact 212. The first normally-closed contact 208 may include the engagement arm 210 that is received into the first contact aperture 256 of the second body half 230*b*. The engagement arm 210 may have any suitable shape, such as, for example, an elongated, cylindrical shape having a longitudinal axis that is coaxially aligned with the longitudinal axis of the first contact aperture 256. The first normally-closed contact 208 may also include an elongated extension arm 272 that extends from a distal end 274 of the engagement arm 210. The extension arm 272 may have any suitable shape, such as, for example, an elongated, cylindrical shape having a longitudinal axis that is disposed orthogonal to the longitudinal axis of the engagement arm 210 such that the first normally-closed contact 208 has an L-shape. With the engagement arm 210 received into the first contact aperture 256 of the second body half 230*b*, the extension arm 272 is longitudinally received into a corresponding groove 262*b* formed on the exterior surface 252*b* of the second body half 230*b* such that a distal end 276 of the extension arm 272 extends beyond the first end 232 of switch body 202. So positioned, the engagement arm 210 that is received into the first contact aperture 256 of the second body half 230*b* may also be at least partially received into the first auxiliary contact aperture 264 of the first body half 230*a* to further secure the engagement arm 210 within the switch body 202.

The second normally-closed contact 212 may include the engagement arm 214 that is received into the second contact aperture 258 of the second body half 230*b* and the second auxiliary contact aperture 266 of the first body half 230*a* in the same manner that the engagement arm 210 of the first normally-closed contact 208 is received into the first contact aperture 256 of the second body half 230*b* and the first auxiliary contact aperture 264 of the first body half 230*a*, respectively. An elongated extension arm 286 may extend from a distal end 288 of the engagement arm 214, and the extension arm 286 may be longitudinally received into a corresponding groove 262*b* formed on the exterior surface 252*b* of the second body half 230*b* such that a distal end 290 of the extension arm 286 extends beyond the first end 232 of switch body 202.

Referring again to FIGS. 7A, 7B, 8A, 8B, 9A, and 9B, the magnetically-triggered proximity switch 200 may include the first normally-open contact 216 and the second normally-open contact 220. The first normally-open contact 216 may include the engagement arm 218 that is received into the first contact aperture 248 of the first body half 230*a* and the first auxiliary contact aperture 268 of the second body half 230*b* in the same manner that the engagement arm 210 of the first normally-closed contact 208 is received into the first contact aperture 256 of the second body half 230*b* and the first auxiliary contact aperture 264 of the first body half 230*a*, respectively. An elongated extension arm 292 may extend from a distal end 294 of the engagement arm 218, and the extension arm 292 may be longitudinally received into a corresponding groove 262*a* formed on the exterior surface 252*a* of the first body half 230*a* such that a distal end 296 of the extension arm 292 extends beyond the first end 232 of switch body 202.

The second normally-open contact 220 may include the engagement arm 222 that is received into the second contact aperture 250 of the first body half 230*a* and the second auxiliary contact aperture 270 of the second body half 230*b* in the same manner that the engagement arm 210 of the first normally-closed contact 208 is received into the first contact aperture 256 of the second body half 230*b* and the first auxiliary contact aperture 264 of the first body half 230*a*, respectively. An elongated extension arm 298 may extend from a distal end 300 of the engagement arm 222, and the extension arm 298 may be longitudinally received into a corresponding groove 262*a* formed on the exterior surface 252*a* of the first body half 230*a* such that a distal end 302 of the extension arm 298 extends beyond the first end 232 of switch body 202. Configured as described, the extension arms 272, 286, 292, 298 may be parallel and the distal ends 284, 290, 296, 302 of the extension arms 272, 286, 292, 298 may each be longitudinally equidistant from the first end 232 of the switch body 202. The first and second normally-closed contacts 208, 212 and the first and second normally-open contact 216, 220 may each be made from any suitable non-magnetic conducting material or combination of materials, such as copper or silver, for example. The first and second first normally-closed contacts 208, 212 and the first and second normally-open contact 216, 220 may also be fully or partially coated (e.g., coated only at portions intended to engage the contact magnet 224) by any suitable plating, such as gold plating.

Once again referring to FIGS. 7A, 7B, 8A, 8B, 9A, and 9B, the magnetically-triggered proximity switch 200 may include a body sleeve 304 that surrounds the switch body 202 from the first end 232 and a second end 234. The body sleeve 304 may correspond in cross-sectional shape to the cross-sectional shape of the switch body 202. For example, if the switch body 202 (that may be comprised of the first body half 230*a* and the second body half 230*b*) has a cylindrical shape having a circular cross-section, the body sleeve 304 may have a cylindrical inner surface 306 and an outer surface 308. The outer surface 308 may have any suitable shape, such as a cylindrical shape, and may include one or more mounting features (not shown). The inner surface 306 may have a diameter that is slightly larger than the outer diameter of the cylindrical exterior surface (i.e., the exterior surfaces 252*a*, 252*b*) of the switch body 202, and a longitudinal axis of the inner surface 306 and the outer surface 308 may be coaxially aligned with the body longitudinal axis 204. A slight gap may exist between the inner surface 306 of the body sleeve 304 and the cylindrical exterior surface 252 of the switch body 202 to accommodate the extension arms 272, 286, 292, 298 disposed in the grooves 262*a*, 262*b* formed in the exterior surfaces 252*a*, 252*b* of the switch body 202, and contact between the inner surface 306 body sleeve 304 the extension arms 272, 286, 292, 298 may maintain the associated engagement arms 210, 214, 218, 222 in a desired position relative to the switch body 202. The gap between the inner surface 306 of the body sleeve 304 and the cylindrical exterior surface 252 of the switch body 202 may be filled with an epoxy and/or any other suitably sealing material to prevent water or dirt from entering the gap. The body sleeve 304 may include an end wall 309 disposed at a longitudinal end of the body sleeve 304 adjacent to the second end 234 of the switch body 202, and the end wall 309 may close off the longitudinal end of the body sleeve 304. The end wall 309 may be planar and may extend normal to the body longitudinal axis 204. Instead of having an end wall 309, the longitudinal end of the body sleeve 304 adjacent to the second end 234 of the switch body 202 may be open. The body sleeve 304 may be formed from any suitable non-conductive and non-magnetic material, such as the same non-conductive plastic material used to form the switch body 202 (e.g., plastic, ceramic, epoxy, or rubber).

As illustrated in FIGS. 7A, 9A, and 9B, the magnetically-triggered proximity switch 200 also includes the contact magnet 224 disposed within the switch body 202. More specifically, the contact magnet 224 may be disposed within the second cavity 240 of the switch body 202 that may be a cylindrical cavity formed by the semi-cylindrical second cavity 240*a* of the first body half 230*a* and the semi-cylindrical second cavity 240*b* of the second body half 230*b*. The contact magnet 224 may be spherical in shape and may have a diameter that is slightly smaller than (e.g., 3% to 15% smaller than) the diameter of the cylindrical second cavity 240. The contact magnet 224 may be made from or coated with a conductive material. For example, the contact magnet 224 may be a spherical neodymium magnet that is gold plated. However, the contact magnet 224 may have any shape or size that allows the contact magnet 224 to longitudinally displace from the first switch position 226 (illustrated in FIG. 9A) to the second switch position 228 (illustrated in FIG. 9B).

Assembled as described, with the bias member 206 in the first cavity 238 of the switch body 202 and the contact magnet 224 disposed within the second cavity 240 of the switch body 202, an attractive magnetic force (i.e., the first magnetic force) acts between the bias member 206 and the contact magnet 224 to maintain the contact magnet 224 in the first switch position 226 (illustrated in FIG. 9A). In this first switch position 226, the conductive contact magnet 224 is in contact with a portion of the engagement arm 210 of the first normally-closed contact 208 and a portion of the engagement arm 214 of the second normally-closed contact 212, thereby completing a circuit between the first normally-closed contact 208 and the second normally-closed contact 212. Also in this first switch position 226, the conductive contact magnet 224 is not in contact with any portion of the engagement arm 218 of the first normally-open contact 216 or any portion of the portion of the engagement arm 222 of the second normally-open contact 220, thereby resulting in an open circuit between the first normally-open contact 216 and the second normally-open contact 220. Accordingly, the closed circuit that results from the first switch position 226 can be detected by a processor, controller, or other detector that is operatively connected to a portion (such as the distal end 284) of the extension arm 272 of the first normally-closed contact 208 and to a portion (such as the distal end 290) of the extension arm 286 of the second normally-closed contact 212. Similarly, the open circuit that results from the first switch position 226 can be detected by a processor, controller, or other detector that is operatively connected to a portion (such as the distal end 296) of the extension arm 292 of the first normally-open contact 216 and to a portion (such as the distal end 302) of the extension arm 298 of the second normally-open contact 220.

However, when a magnetic target 310, which may be formed from or include a permanent magnet or a ferrous metal, is moved into a position within a predetermined range of the proximity switch 200, as illustrated in FIG. 9B, the magnetic force between the target 310 and the contact magnet 224 (i.e., the second magnetic force) may be greater than the first magnet force (i.e., the attractive magnetic force between the contact magnet 224 and the bias member 206). Within the predetermined range, the more powerful second magnetic force acts to longitudinally displace the contact magnet 224 from the first switch position 226 illustrated in FIG. 9A to the second switch position 228 illustrated in FIG. 9B. In this second switch position 228, the conductive contact magnet 224 is in contact with a portion of the engagement arm 218 of the first normally-open contact 216 and a portion of the engagement arm 222 of the second normally-open contact 220, thereby completing a circuit between the first normally-open contact 216 and the second normally-open contact 220. Accordingly, the closed circuit that results from the second switch position 228 can be detected by a processor, controller, or other detector that is operatively connected to a portion (such as the distal end 296) of the extension arm 292 of the first normally-open contact 216 and to a portion (such as the distal end 302) of the extension arm 298 of the second normally-open contact 220. Also in this second switch position 228, the conductive contact magnet 224 is not in contact with any portion of the engagement arm 210 of the first normally-closed contact 208 or any portion of the engagement arm 214 of the second normally-closed contact 212, thereby resulting in an open circuit between the first normally-closed contact 208 and the second normally-closed contact 212. Accordingly, the open circuit that results from the second switch position 228 can be detected by a processor, controller, or other detector that is operatively connected to connected to a portion (such as the distal end 284) of the extension arm 272 of the first normally-closed contact 208 and to a portion (such as the distal end 290) of the extension arm 286 of the second normally-closed contact 212.

When the target 310 is no longer within the predetermined range of the proximity switch 200, the magnetic force between the bias member 206 and the contact magnet 224 (i.e., the first magnetic force) becomes greater than the magnetic force between the contact magnet 224 and the target 310 (i.e., the second magnetic force), and the first magnetic force longitudinally displaces the contact magnet 224 from the second switch position 228 to the first switch position 226 in the manner described above.

As previously explained, the circumferential cavity surface 246*a* of the first body half 230*a* and the circumferential cavity surface 246*b* of the second body half 230*b* cooperate to form or at least partially define the cylindrical surface of the second cavity 240. The cylindrical surface of the second cavity 240 may have any suitable diameter that allows the contact magnet 224 to longitudinally displace from the first switch position 226 to the second switch position 228 and vice versa. More specifically, the cylindrical surface of the second cavity 240 may be adapted to limit or prevent movement of the contact magnet 224 in a direction normal to the body longitudinal axis 204 when the contact magnet 224 is in the first switch position 226, the second switch position 228, or longitudinally displacing from the second switch position 228 to the first switch position 226 (and vice versa). Preferably, the diameter of the cylindrical surface of the second cavity 240 may be slightly larger (e.g., 5% to 15% larger) than the diameter of the spherical contact magnet 224.

One having ordinary skill in the art would recognize that the magnetic force between the target 310 and the contact magnet 224 may depend on several factors, such as the relative size of the target 310 and the contact magnet 224, the distance between the target 310 and the contact magnet 224, and these variables can be adjusted to provide a desired predetermined range for a particular application. In a similar manner the magnetic force between the contact magnet 224 and the bias member 206 can also be adjusted.

One having ordinary skill in the art would also recognize that the disclosed embodiments of the magnetically-triggered proximity switch 200 allow for a relatively small switch 202 having a simple actuating mechanism that includes a single moving part (i.e., the contact magnet 224) that acts as both an actuator and a contact. This simplified design minimizes the number of assembly components and reduces the number of assembly operations, thereby reducing manufacturing costs and assembly time. The simplified design also permits an overall size reduction (limited only by the contact magnet's 224 diameter) that allows the magnetically-triggered proximity switch 200 to be used in applications with limited space requirements, such as in electrical junction boxes. Because the magnetically-triggered proximity switch 200 is intended for the switching of PLC level loads (such as 5V, for example) or lower, the contact sizes can be correspondingly small, thereby allowing for a further size reduction of the proximity switch 200. It is also apparent to one having ordinary skill in the art that an external power source is not necessary, thereby simplifying installation and extending the working life of the proximity switch 200.

While various embodiments have been described above, this disclosure is not intended to be limited thereto. Variations can be made to the disclosed embodiments that are still within the scope of the appended claims. For example, two or more switching circuits (each including, for example, a bias member 206, a contact magnet 224, and a plurality of contacts 208, 212, 216, 220) may be included in a single switch body 202 of the proximity switch 200, and each switching circuit may operate independently to allow a contact magnet 224 of each circuit to move from a first switch position 226 to a second switch position 228 in the manner previously described. The two or more switching circuits may be positioned in a linear orientation within the switch body 202 to measure linear travel. Alternatively, the two or more switching circuits may be disposed in a grid pattern within the switch body 202 to allow for X-Y target positioning (e.g., positioning in a direction along the body longitudinal axis 204 and normal to the body longitudinal axis 204). In additional embodiments, the proximity switch 200 may be hermetically sealed to protect the proximity switch 200 from water or dirt particles or to allow the proximity switch 200 to be used in hazardous locations. In addition, LEDS may be included in or on a portion of the switch body 202 or the body sleeve 204 to visually indicate whether the proximity switch 200 is in the first switch position 226 or the second switch position 228.

What is claimed is:

1. A magnetically-triggered proximity switch comprising:

a switch body extending along a body longitudinal axis;

a bias member non-movably secured within the switch body;

a first normally-closed contact having an engagement arm;

a second normally-closed contact having an engagement arm;

a first normally-open contact having an engagement arm;

a second normally-open contact having an engagement arm;

a contact magnet disposed within the switch body, the contact magnet being movable relative to the bias member such that the contact magnet is movable between a first switch position and a second switch position, wherein in the first switch position, the contact magnet contacts a portion of the engagement arm of the first normally-closed contact and a portion of the engagement arm of the second normally-closed contact, thereby completing a circuit between the first normally-closed contact and the second normally-closed contact, wherein in the second switch position, the contact magnet contacts a portion of the engagement arm of the first normally-open contact and a portion of the engagement arm of the second normally-open contact, thereby completing a circuit between the first normally-open contact and the second normally-open contact, wherein the engagement arm of each of the first normally-closed contact, the second normally-closed contact, the first normally-open contact, and the second normally-open contact has an elongated shape having a longitudinal axis, and wherein each of the first normally-closed contact, the second normally-closed contact, the first normally-open contact, and the second normally-open contact has an elongated extension arm that extends from a distal end of the engagement arm in a direction parallel to the body longitudinal axis.

2. The magnetically-triggered proximity switch of claim 1, wherein the contact magnet is spherical in shape.

3. The magnetically-triggered proximity switch of claim 1, wherein the bias member and the contact magnet are selected to create a first magnetic force between the bias member and the contact magnet, and the first magnetic force maintains the contact magnet in the first switch position, and wherein the contact magnet and a target outside of the switch body are selected to create a second magnetic force between the contact magnet and the target, and the second magnetic force causes the contact magnet to move from the first switch position to the second switch position if the second magnetic force is greater than the first magnetic force.

4. The magnetically-triggered proximity switch of claim 3, wherein when the second magnetic force between the target and the contact magnet becomes weaker than the first magnetic force between the bias member and the contact magnet, the first magnetic force causes the contact magnet to move from the second switch position to the first switch position.

5. The magnetically-triggered proximity switch of claim 2, wherein the contact magnet is disposed within a cylindrical second cavity formed in the switch body, wherein a cylindrical surface that at least partially defines the second cavity is adapted to limit or prevent movement of the contact magnet in a direction normal to the body longitudinal axis.

6. The magnetically-triggered proximity switch of claim 1, wherein the contact magnet displaces along the body longitudinal axis between the first switch position and the second switch position.

7. The magnetically-triggered proximity switch of claim 1, wherein the longitudinal axis of the engagement arm of each of the first normally-closed contact and the second normally-closed contact extends along a first reference plane that is orthogonal to the body longitudinal axis.

8. The magnetically-triggered proximity switch of claim 7, wherein the longitudinal axis of the engagement arm of each of the first normally-open contact and the second normally-open contact extends along a second reference plane that parallel to and offset from the first reference plane.

9. The magnetically-triggered proximity switch of claim 8, wherein the bias member is disposed adjacent to a first end of the switch body and the second reference plane is disposed adjacent to a second end of the switch body.

10. The magnetically-triggered proximity switch of claim 1, wherein the engagement arm of each of the first normally-closed contact, the second normally-closed contact, the first normally-open contact, and the second normally-open contact has a cylindrical shape.

11. The magnetically-triggered proximity switch of claim 2, wherein the contact magnet is a gold-plated neodymium magnetic sphere.

12. The magnetically-triggered proximity switch of claim 1, wherein the switch body comprises a first body half and a second body half, wherein the first body half and the second body half combine to form a cylindrical shape.

13. The magnetically-triggered proximity switch of claim 12, wherein the switch body is disposed within a cylindrical body sleeve.

14. The magnetically-triggered proximity switch of claim 13, wherein the first body half, the second body half, and the body sleeve are comprised of plastic.

15. The magnetically-triggered proximity switch of claim 1, wherein the bias member is longitudinally spaced apart from the contact magnet.

16. A method of detecting a target by a magnetically-triggered proximity switch comprising:

providing a switch body that extends along a body longitudinal axis;

disposing a pair of normally-closed contacts within the switch body, each of the pair of normally-closed contacts having an engagement arm that has an elongated shape having a longitudinal axis, and wherein an elongated extension arm extends from a distal end of each of the engagement arms of the pair of normally-closed contacts in a direction parallel to the body longitudinal axis;

disposing a pair of normally-open contacts within the switch body, each of the pair of normally-open contacts having an engagement arm that has an elongated shape having a longitudinal axis, and wherein an elongated extension arm extends from a distal end of each of the engagement arms of the pair of normally-open contacts in a direction parallel to the body longitudinal axis;

positioning a stationary bias member within the switch body;

movably disposing a contact magnet adjacent to the bias member;

biasing the contact magnet into engagement with each of the engagement arms of the pair of normally-closed contacts by the force of the bias member acting on the contact magnet; and positioning a target at a first location outside of the switch body such that the magnetic force between the target and the contact magnet is greater than the magnetic force between the bias member and the contact magnet, thereby moving the contact magnet out of engagement with each of the engagement arms of the pair of normally-closed contacts and into engagement with each of the engagement arms of the pair of normally-open contacts.

17. The method of claim 16, further comprising positioning the target at a second location outside of the switch body such that the magnetic force between the target and the contact magnet is less than the magnetic force between the bias member and the contact magnet, thereby moving the contact magnet such that the contact magnet disengages from each of the engagement arms of the pair of normally-open contacts and engages each of the engagement arms of the pair of normally-closed contacts.

18. The method of claim 16, further comprising providing a spherical magnet as the contact magnet, and disposing the spherical magnet within a cylindrical cavity formed within the switch body to prevent or limit transverse displacement of the spherical magnet relative to the switch body as the spherical magnet moves out of engagement with each of the engagement arms of the pair of normally-closed contacts and into engagement with each of the engagement arms of the pair of normally-open contacts.

* * * * *